US007048065B2

(12) United States Patent
Badrak et al.

(10) Patent No.: US 7,048,065 B2
(45) Date of Patent: May 23, 2006

(54) METHOD AND APPARATUS FOR EXPANDABLE LINER HANGER WITH BYPASS

(75) Inventors: Robert P. Badrak, Sugar Land, TX (US); Robert J. Coon, Missouri City, TX (US); Roddie R. Smith, Cypress, TX (US); Patrick G. McGuire, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/168,803

(22) Filed: Jun. 28, 2005

(65) Prior Publication Data

US 2005/0236162 A1 Oct. 27, 2005

Related U.S. Application Data

(63) Continuation of application No. 10/713,711, filed on Nov. 14, 2003, now Pat. No. 6,920,934, which is a continuation of application No. 09/904,735, filed on Jul. 13, 2001, now Pat. No. 6,648,075.

(51) Int. Cl.
*E21B 43/10* (2006.01)

(52) U.S. Cl. ..... 166/382; 166/207; 166/208

(58) Field of Classification Search ..... 166/206–208, 166/381–384; 405/184.3
See application file for complete search history.

(56) References Cited

U.S. PATENT DOCUMENTS

| | | | | |
|---|---|---|---|---|
| 3,412,565 | A * | 11/1968 | Lindsey et al. | 405/231 |
| 2004/0159446 | A1* | 8/2004 | Haugen et al. | 166/384 |
| 2005/0023001 | A1* | 2/2005 | Hillis | 166/380 |

* cited by examiner

*Primary Examiner*—Kenneth Thompson
(74) *Attorney, Agent, or Firm*—Patterson & Sheridan, L.L.P.

(57) ABSTRACT

The present invention provides a liner hanger and a method of hanging a liner in a wellbore. In one aspect, a process for setting a liner in a wellbore is provided in which a tubular having a slip formed on an outer diameter of the tubular at a first location and a preformed bypass for circulating a fluid disposed at a second location is set and expanded into substantial contact with an inner diameter of the wellbore, a casing, or another liner. In another aspect, a process for setting a liner in a wellbore is provided in which a tubular having a slip formed on an outer diameter of the tubular at a first location is placed in the wellbore, a bypass for circulating a fluid is formed downhole, the liner is set and expanded into substantial contact with an inner diameter of the wellbore, a casing, or another liner. In yet another aspect, a process for creating a liner top seal is provided in which the liner is set by expanding a protrusion in an upper end of a tubular into substantial contact with an inner diameter of the wellbore, and the upper end of the tubular is then reformed and expanded into substantial contact with the inner diameter of the wellbore.

20 Claims, 8 Drawing Sheets

METHOD AND APPARATUS FOR EXPANDABLE LINER HANGER WITH BYPASS

CROSS-REFERENCE TO RELATED APPLICATIONS

This application is a continuation of U.S. patent application Ser. No. 10/713,711 filed Nov. 14, 2003 now U.S. Pat. No. 6,920,934, which is a continuation of Ser. No. 09/904,735 filed Jul. 13, 2001, now U.S. Pat. No. 6,648,075, issued Nov. 18, 2003, and are herein incorporated by reference in their entirety.

BACKGROUND OF THE INVENTION

1. Field of the Invention

The invention relates to well drilling and completion, and to an apparatus and methods for use with expandable tubulars. Generally, the invention relates to a liner hanger and a method of hanging a liner.

2. Background of the Related Art

In the oil and gas exploration and production industry, bore holes are drilled in the earth to access hydrocarbon-bearing formations. The drilled bores are lined with steel tubing, known as casing or liner, which is cemented in the bore. After a certain depth is reached, drilling is halted and a well casing is lowered down the wellbore and cemented in place. Typically, drilling resumes in the wellbore until a next predetermined depth is reached. At this stage, drilling is halted and a liner is lowered down the well casing. The liner is suspended from the well casing or from a previous string of liner by a liner hanger which utilizes slips and cones and acts between the liner and the well casing. The purpose of casing and liner is to provide support to the wellbore and facilitate isolation of certain parts of the wellbore.

The liner can be set mechanically or hydraulically. A typical apparatus for setting a liner in a well casing includes a liner hanger and a running tool. The running tool is provided with a valve seat obstruction which will allow fluid pressure to be developed to actuate the slips in order to set the liner hanger in the well casing. Once the liner hanger has been set, the running tool is rotated anti-clockwise to unscrew the running tool from the liner hanger and the running tool is then removed.

A recent trend in well completion has included expandable tubular technology. Both slotted and solid tubulars can be expanded in situ to enlarge a fluid path through the tubular and also to fix a smaller tubular within the inner diameter of a larger tubular therearound. Tubulars are expanded by the use of a cone-shaped mandrel or by an expansion tool with expandable, fluid actuated members disposed on a body and run into the wellbore on a tubular string. During expansion of a tubular, the tubular walls are expanded past their elastic limit. Examples of expandable tubulars include slotted screen, joints, packers, and liners. FIG. 1 is an exploded view of an exemplary expansion tool 100. The expansion tool 100 has a body 102 which is hollow and generally tubular with connectors 104 and 106 for connection to other components (not shown) of a downhole assembly. The connectors 104 and 106 are of a reduced diameter compared to the outside diameter of the longitudinally central body part of the tool 100. The central body part has three recesses 114 to hold a respective roller 116. Each of the recesses 114 has parallel sides and extends radially from a radially perforated tubular core (not shown) of the tool 100. Each of the mutually identical rollers 116 is somewhat cylindrical and barreled. Each of the rollers 116 is mounted by means of an axle 118 at each end of the respective roller and the axles are mounted in slidable pistons 120. The rollers are arranged for rotation about a respective rotational axis which is parallel to the longitudinal axis of the tool 100 and radially offset therefrom at 120-degree mutual circumferential separations around the central body. The axles 118 are formed as integral end members of the rollers and the pistons 120 are radially slidable, one piston 120 being slidably sealed within each radially extended recess 114. The inner end of each piston 120 is exposed to the pressure of fluid within the hollow core of the tool 100 by way of the radial perforations in the tubular core. In this manner, pressurized fluid provided from the surface of the well, via a tubular, can actuate the pistons 120 and cause them to extend outward and to contact the inner wall of a tubular to be expanded. Additionally, at an upper and a lower end of the expansion tool 100 are a plurality of non-compliant rollers 103 constructed and arranged to initially contact and expand a tubular prior to contact between the tubular and fluid actuated rollers 116. Unlike the compliant, fluid actuated rollers 116, the non-compliant rollers 103 are supported only with bearings and they do not change their radial position with respect to the body portion of the tool 100.

One use for expandable tubulars is to hang one tubular within another. For example, the upper portion of a liner can be expanded into contact with the inner wall of a casing in a wellbore. In this manner, the bulky and space-demanding slip assemblies and associated running tools can be eliminated. One problem with expandable tubular technology used with liners relates to cementing. Cementing is performed by circulating the uncured cement down the wellbore and back up an annulus between the exterior of the liner and the borehole therearound. In order for the cement to be circulated, a fluid path is necessary between the annulus and the wellbore. Hanging a liner in a wellbore by circumferentially expanding its walls into casing seals the juncture and prevents circulation of fluids. In order to avoid this problem, liners must be either temporarily hung in a wellbore or, more preferably, partially expanded prior to cementing whereby the liner is suspended in the casing but a fluid path remains back to the surface of the well. The problem is usually addressed by partially expanding the liner in order to hang it in the wellbore and then finishing the expansion after the cementing is done but prior to the curing of the cement. However, the tools for expanding tubulars are typically designed to expand the tubular in a circumferential fashion and cannot be effectively used to only partially expand the tubular.

Therefore, there is a need for a liner hanger apparatus and method that permits a liner to be hung in a well and also permits a fluid path around the liner, at least temporarily. There is a further need for a liner hanger that can be partially expanded into a casing but leaves a fluid path therearound. Additionally, there is a need for improved expandable liner hangers with a means for circulating fluids therearound.

SUMMARY OF THE INVENTION

The present invention generally relates to a liner hanger and a method of hanging a liner. In one aspect, a method and apparatus for setting a liner in a wellbore is provided in which a tubular having a slip surface formed on an outer diameter of the tubular at a first location and a preformed bypass formed at a second location is placed in the wellbore at a predetermined depth. A setting tool on a run-in string is placed in the tubular and energized to cause an extendable member therein to extend radially to contact an inner diameter of the tubular opposite the location of the slip surface, thereby expanding the tubular at the first location into substantial contact with an inner diameter of the wellbore. In this manner, the tubular is fixed in the wellbore. A fluid, such as cement for cementing the liner into the wellbore, is then circulated into the wellbore with return fluid passing through the preformed bypass. An expansion tool on a run-in string is placed in the tubular and energized and/or rotated to cause an extendable member therein to radially contact the inner diameter of the tubular thereby expanding the tubular fully into circumferential contact with the inner diameter of the wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 2:
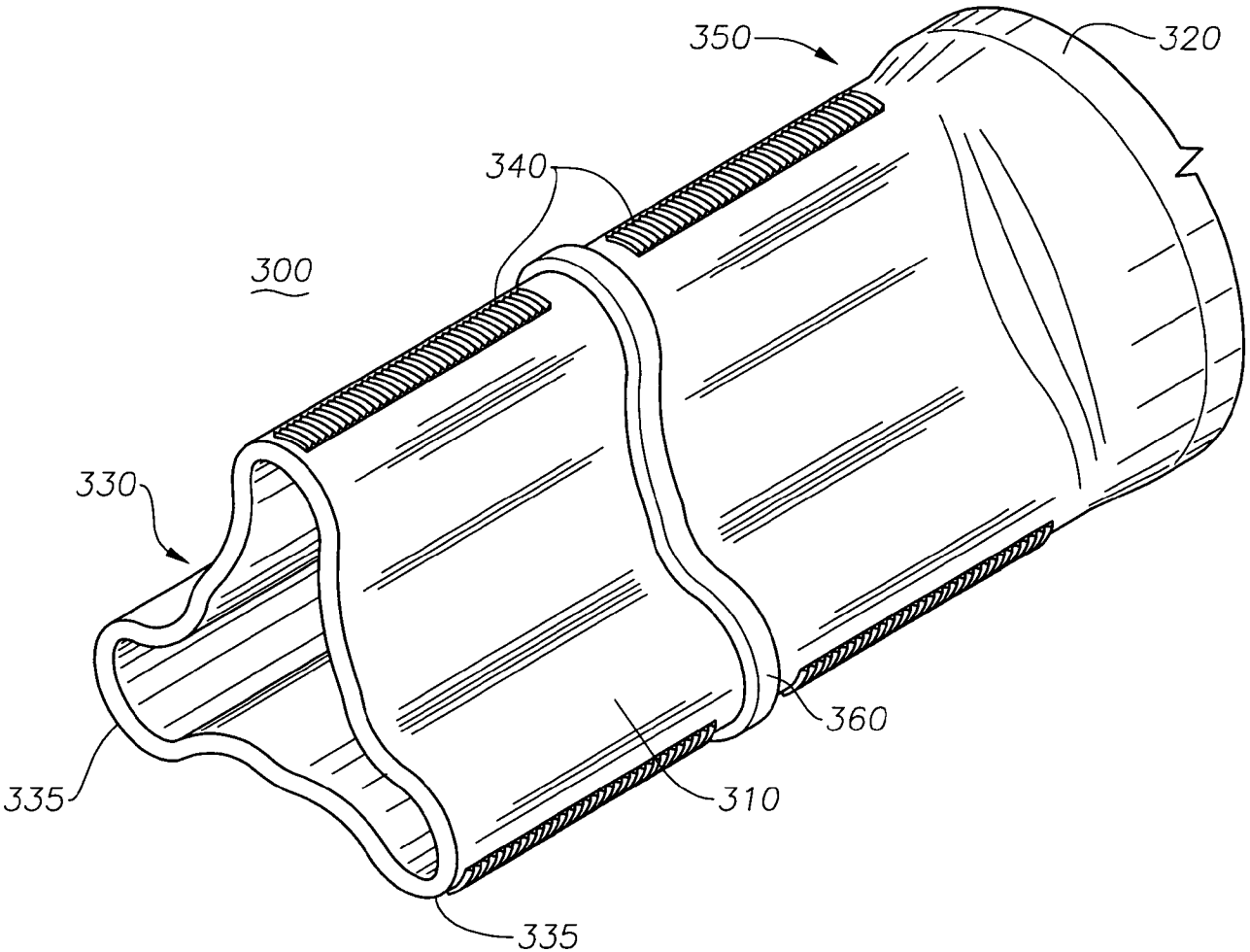
FIG. 2 is a perspective view of an embodiment of a liner hanger according to the invention.

The present invention provides apparatus and method for setting a liner in a wellbore. FIG. 2 is a perspective view of a liner hanger 300 according to one embodiment of the invention. The liner hanger 300 has a generally tubular body 350 with an upper end 310 and a lower end 320. The upper end 310 has a maximum diameter smaller than the lower end 320 and is made of an expandable, ductile material. One or more slips 340 are formed on an outer diameter of the upper end 310 at a first location, or leg 335. The slips have grit or teeth on an outer surface thereof to help set the slips into the surrounding wellbore and hold the liner in place. Bypass areas 330 are formed between the legs 335 to permit a fluid path down the exterior of the liner. Preferably, three legs 435 are formed in the liner hanger 420 with a slip 440 formed on the outer diameter of each thereof. The liner hanger 300 is preformed into an irregular shape to create the bypass areas 330. The areas 330 may be any appropriate shape which allows for adequate fluid circulation between an upper and lower end of the liner hanger 300 and subsequent circumferential expansion of the liner hanger 300. Depending on application needs, a more free-formed shape may be desired to provide a thicker liner wall after the upper end has been reformed into a circular shape and expanded into the surrounding casing. Alternatively, the upper end of the tubular may be circumferential or cylindrical in shape and the bypass 330 may be formed downhole. A sealing member 360, such as an elastomeric ring is disposed around the outside diameter of the upper end to seal an annular area between the liner and an outer tubular.

Figure 3:
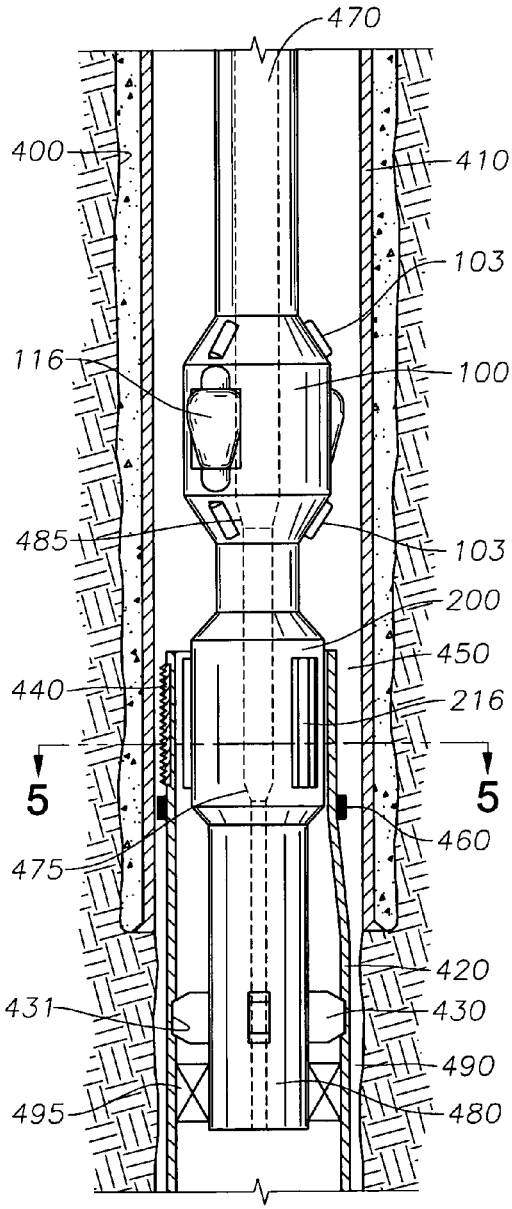
FIG. 3 is a section view of an embodiment of the invention including a first tubular disposed within a wellbore and an assembly disposed within the first tubular having an expansion tool, a setting tool, and a liner hanger disposed on an end of a run-in tubular.

FIG. 3 is a section view of an embodiment of the invention including a first tubular, such as a casing 410, disposed within a wellbore 400 and an assembly disposed within the casing 410. The assembly includes an expansion tool 100, a setting tool 200, and carrying dogs 430 disposed on a run-in string of tubulars 470. Disposed around the assembly is a second tubular, or liner, including the liner hanger 420 at an upper end thereof. The liner is run into the wellbore with the assembly. During run-in, the liner hanger 420 is temporarily attached to the assembly with the carrying dogs 430 so that its weight is borne by the run-in string 470. The carrying dogs 430, in the illustrated embodiment, include radially extendable members which are mechanically held against the liner wall and interact with a mating recess 431 formed on the inside surface of the liner hanger 420. Typically, the carrying dogs 430 are set when the assembly is assembled at the surface of the wellbore 400. In this manner, the weight of the liner is borne by the assembly/run-in string until the liner is set in the casing. At a predetermined time, the carrying dogs 430 can be disengaged. Alternatively, the temporary connection between the assembly and the liner may be a shearable connection or an anchor.

Figure 1:
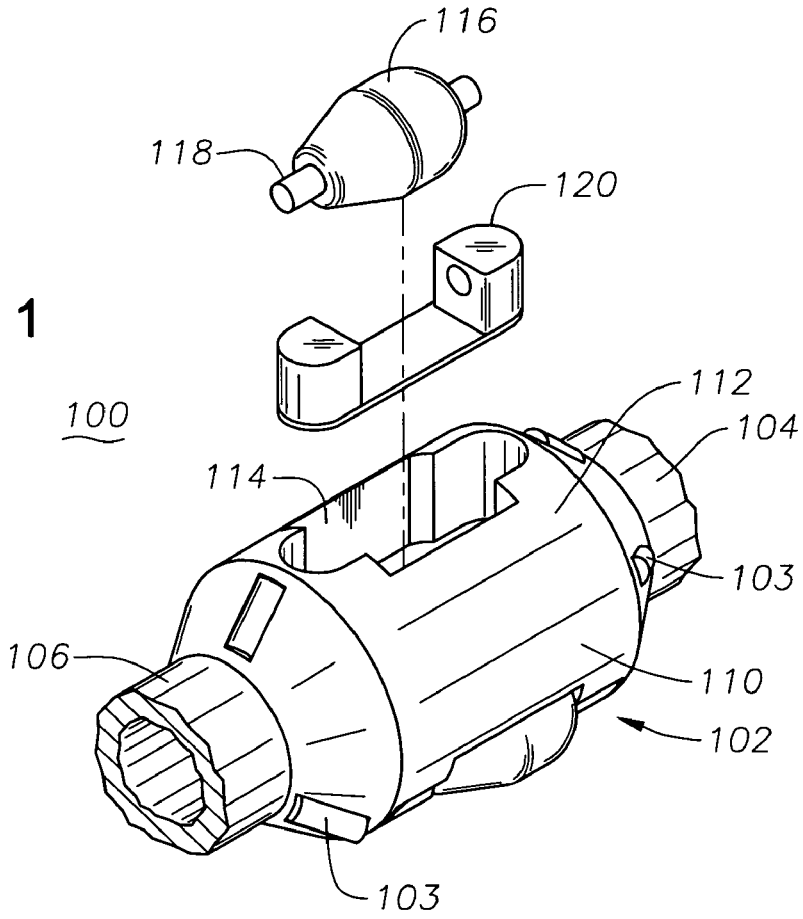
FIG. 1 is an exploded view of an expansion tool.
Figure 4:
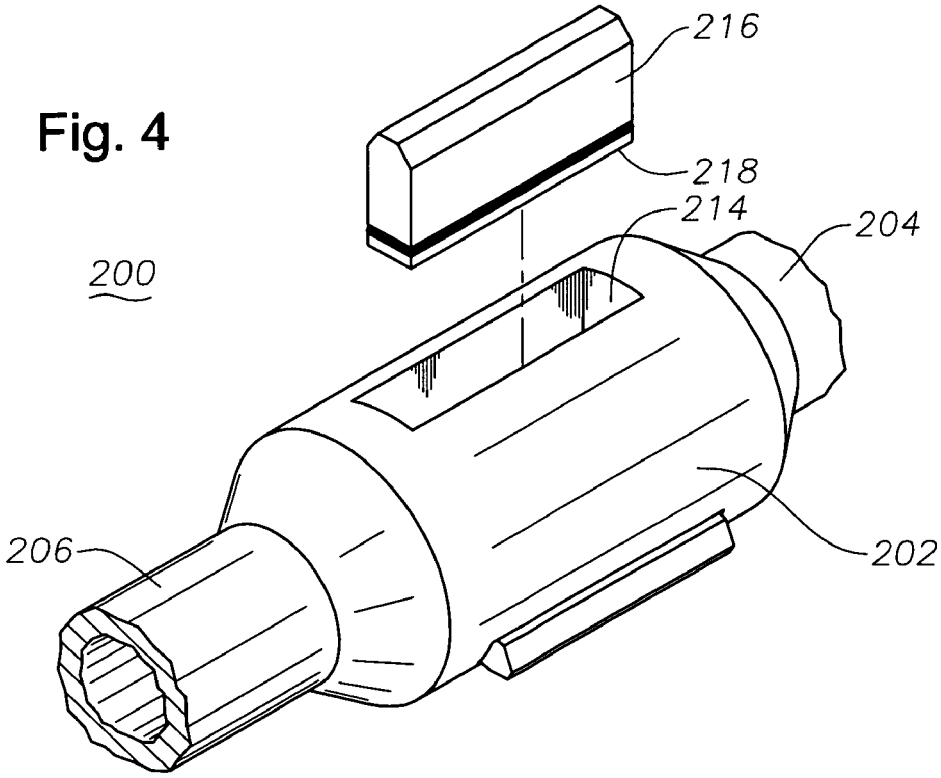
FIG. 4 is an exploded view of a setting tool.

FIG. 4 is an exploded view-of an exemplary setting tool 200. The setting tool 200 has a body 202 which is hollow and generally tubular with connectors 204 and 206 for connection to other components (not shown) of a downhole assembly. The central body part has a recess 214 to hold radially extendable setting members 216. Each of the recesses 214 has parallel sides and extends from a radially perforated inner tubular core (not shown) to the exterior of the tool 200. Each mutually identical setting member 216 is generally rectangular having a beveled setting surface and a piston surface 218 on the back thereof in fluid communication with pressurized fluid delivered by the tubular string 470. Pressurized fluid provided from the surface of the well, via the tubular or run-in string 470, can actuate the setting members 216 and cause them to extend outward and to contact the inner wall of a tubular, or liner hanger 420, to be expanded.

Referring again to FIG. 3, the assembly includes the liner hanger 420 having one or more slips 440 disposed on one or more legs 335, one or more bypass areas 450, a sealing member 460, and carrying dogs 430. The sealing member 460 is disposed on the outer diameter of the liner hanger 420 below the slip 440. Alternatively, slips may be placed above and below the sealing member 460. The run-in string 470 is open at a lower end 480 to permit fluid, such as cement, to pass through the apparatus and to circulate back to the surface of the well through an annulus 490, between the liner hanger 420 and the wellbore 400, and the bypass 450 formed in the liner hanger 420. A bridge plug 495 disposed below the assembly prevents fluid from flowing upwards through the inner diameter of the liner hanger 420.

Fluid pressure in the run-in string 470 is used to selectively activate and deactivate the expansion tool 100 and setting tool 200 through the use of balls and frangible ball seats 475, 485 formed in the central bore of each tool. As illustrated in FIG. 3, the setting tool 200 has a ball seat 475 formed in its interior. The seat is constructed and arranged to receive a ball (not shown) of a given diameter dropped from above. The ball, when landed in the seat 475, redirects fluid from the central bore of the setting tool 200 to radially extending ports (not shown) and into fluid communication with the setting members 216. In this manner, the setting members are urged outwards. At a predetermined pressure over and above the operating pressure of the setting tool 200, the frangible ball seat 475 fails and the ball can fall through the assembly, re-opening the central bore of the tool 200 to the flow of fluid. Thereafter, the setting tool 200 is not affected by fluid passing through the assembly and the pressure actuated setting members 216 will be inoperable and will remain in a biased, retracted position.

Similarly, expansion tool 100 includes a frangible ball seat 485 formed in its interior. The ball seat 485 in the expansion tool 100 is necessarily a larger diameter than the ball seat 475 in setting tool 200. The larger diameter of the expansion tool ball seat 485 permits a ball intended for use in the ball seat 475 of the setting tool 200 to pass through ball seat 485 of the expansion tool 100. With a properly sized ball located in the ball seat 485, fluid pressure will be redirected to the radially extendable rollers 116 of the expansion tool 100, permitting the tool 100 to operate. At a predetermined pressure over and above the operating pressure of the expansion tool 100, the frangible ball seat 485 fails and the ball is displaced to allow fluid flow through the central bore of the tool. Alternatively, the expansion tool or the setting tool could be operated selectively with a flapper valve that is initially open but can be closed to permit pressure to be developed thereabove. After operation of the tool, the flapper valve can be made to fail with pressure, thereby re-opening the bore to the flow of fluid.

Figure 5:
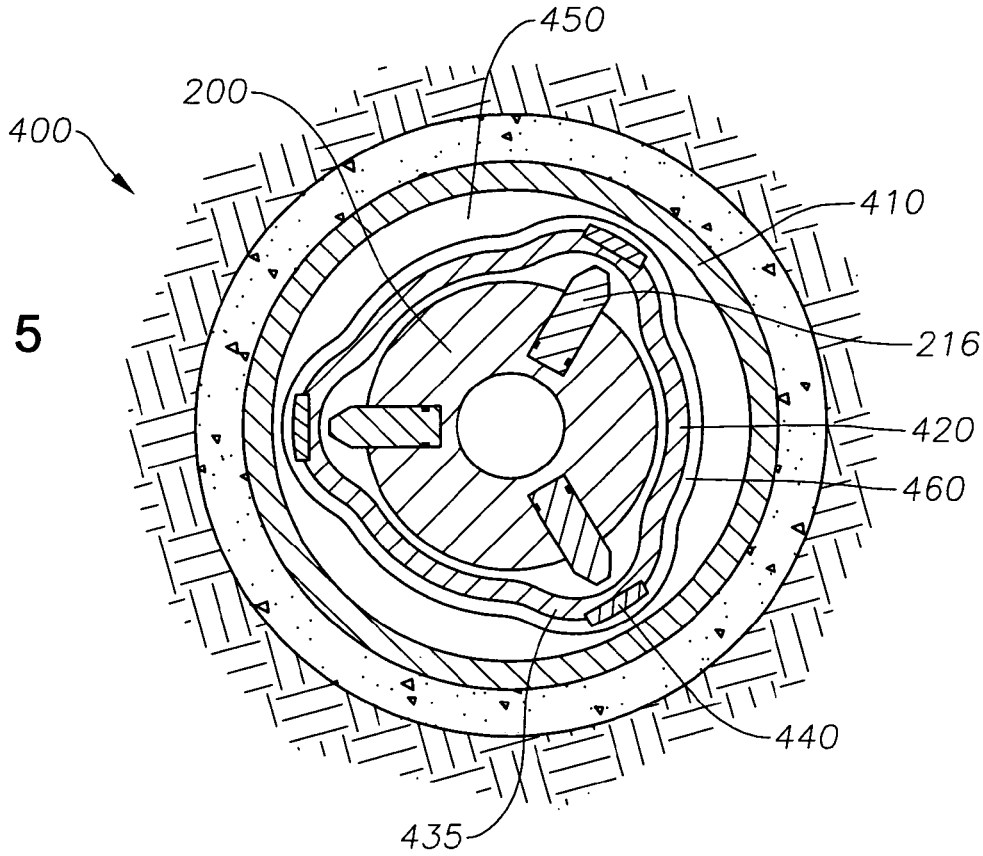
FIG. 5 is a top view of FIG. 3 taken along line 5—5.

FIG. 5 is a top view of FIG. 3 taken along line 5—5. The setting tool 200 is shown in the run-in position with the setting members 216 retracted. The setting members are positioned adjacent the legs 435 which will be expanded radially outwards causing slips 440 to contact the casing 410.

Figure 6:
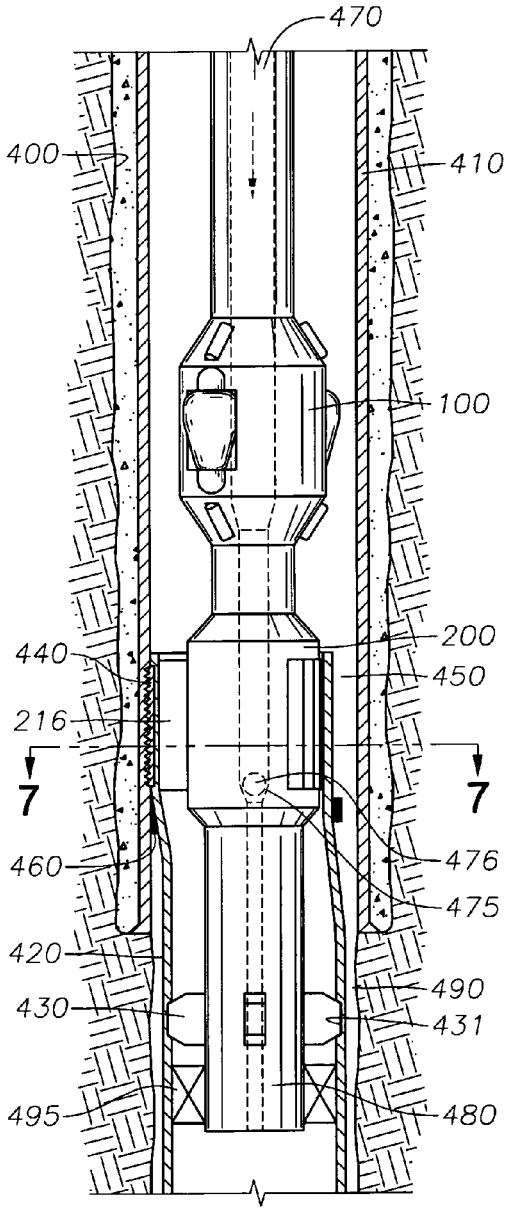
FIG. 6 is a section view of the embodiment shown in FIG. 3, wherein the liner hanger has been hung with the setting tool.
Figure 7:
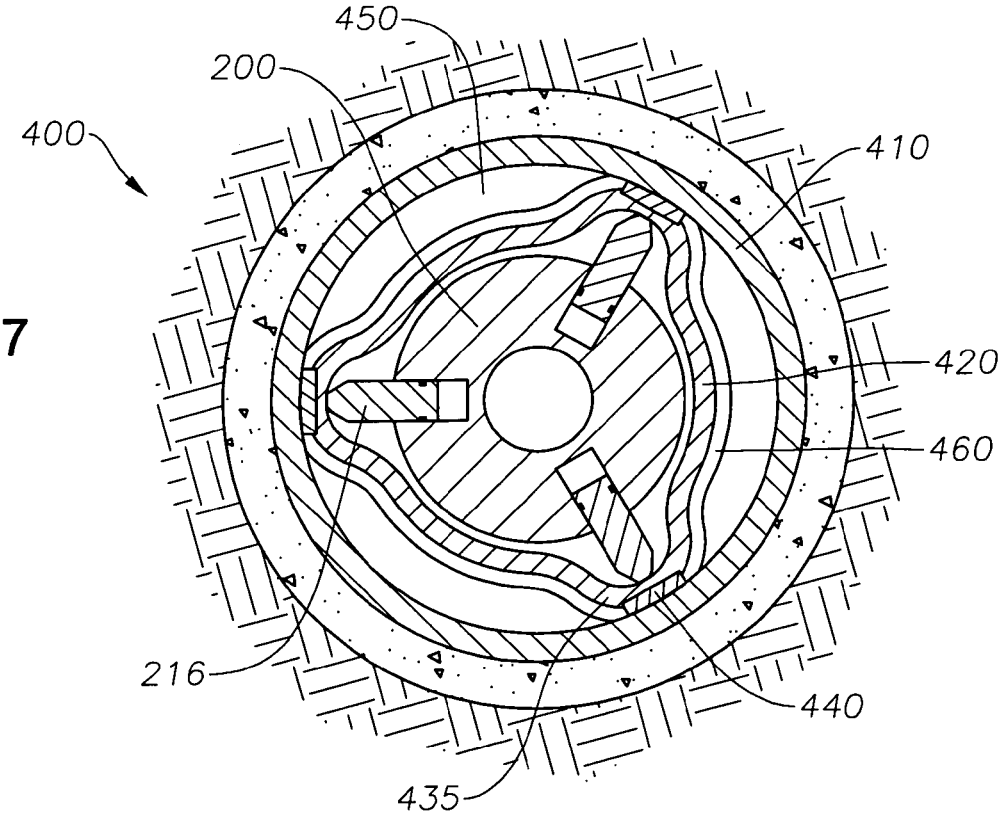
FIG. 7 is a top view of FIG. 6 taken along line 7—7.

FIG. 6 is a section view of the embodiment shown in FIG. 3, showing the slips 440 of the liner as they are set in the casing. As shown, the setting members 216 are temporarily in contact with the wall of the liner. A ball 476 is shown in ball seat 475 which has served to redirect fluid to the setting members. FIG. 7 is a top view of FIG. 6 taken along line 7—7. The setting members 216 have been actuated, engaging the legs 435 and expanding the slips 440 into substantial contact with the inner diameter of the casing 410. After the liner is set in the casing, the pressure of the fluid is reduced and the setting members of the tool 200 return to a biased, retracted position.

Figure 8:
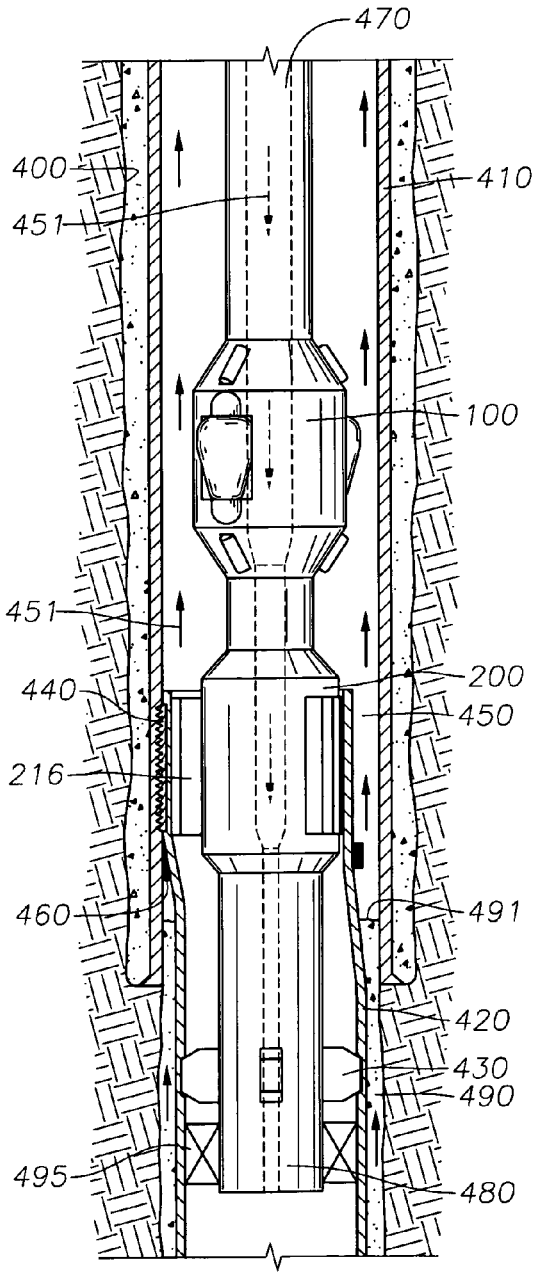
FIG. 8 is a section view of the embodiment shown in FIGS. 3 and 6; illustrating a bypass area for fluid flow.

FIG. 8 is a section view of the embodiment shown in FIGS. 3 and 6 showing the flow of a fluid in the wellbore after the liner hanger 420 has been set. A conditioning fluid or cement follows the path illustrated by arrows 451 down the run-in string 470 and back up to the surface of the well through the preformed bypasses 450 in the liner hanger 420. The first ball 476 (not shown) and ball seat 475 have been blown out of the setting tool 200 allowing fluid to pass through the run-in string 470 and returns to pass through the bypass 450 and annulus 490. The bridge plug 495 prevents the return fluid from passing through the inner diameter of the liner hanger 420. Visible in FIG. 8 is cement in annulus 490 which had been circulated to a desired level 491.

Figure 9:
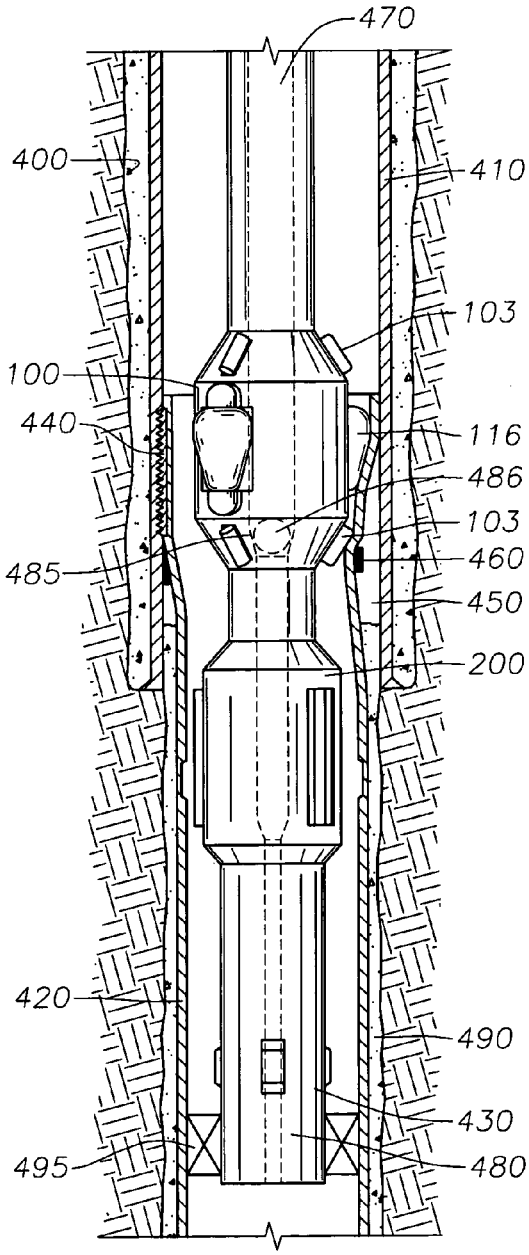
FIG. 9 is a section view of the embodiment shown in FIGS. 3, 6 and 8, wherein the liner hanger has been partially expanded.

FIG. 9 is a section view of the embodiment shown in FIGS. 3, 6 and 8, illustrating the liner hanger 420 as it is expanded into the casing 410. A second ball 486 has been dropped into the second ball seat 485 redirecting pressurized fluid through the run-in string 470 and activating the rollers 116 of the expansion tool 100.

Figure 10:
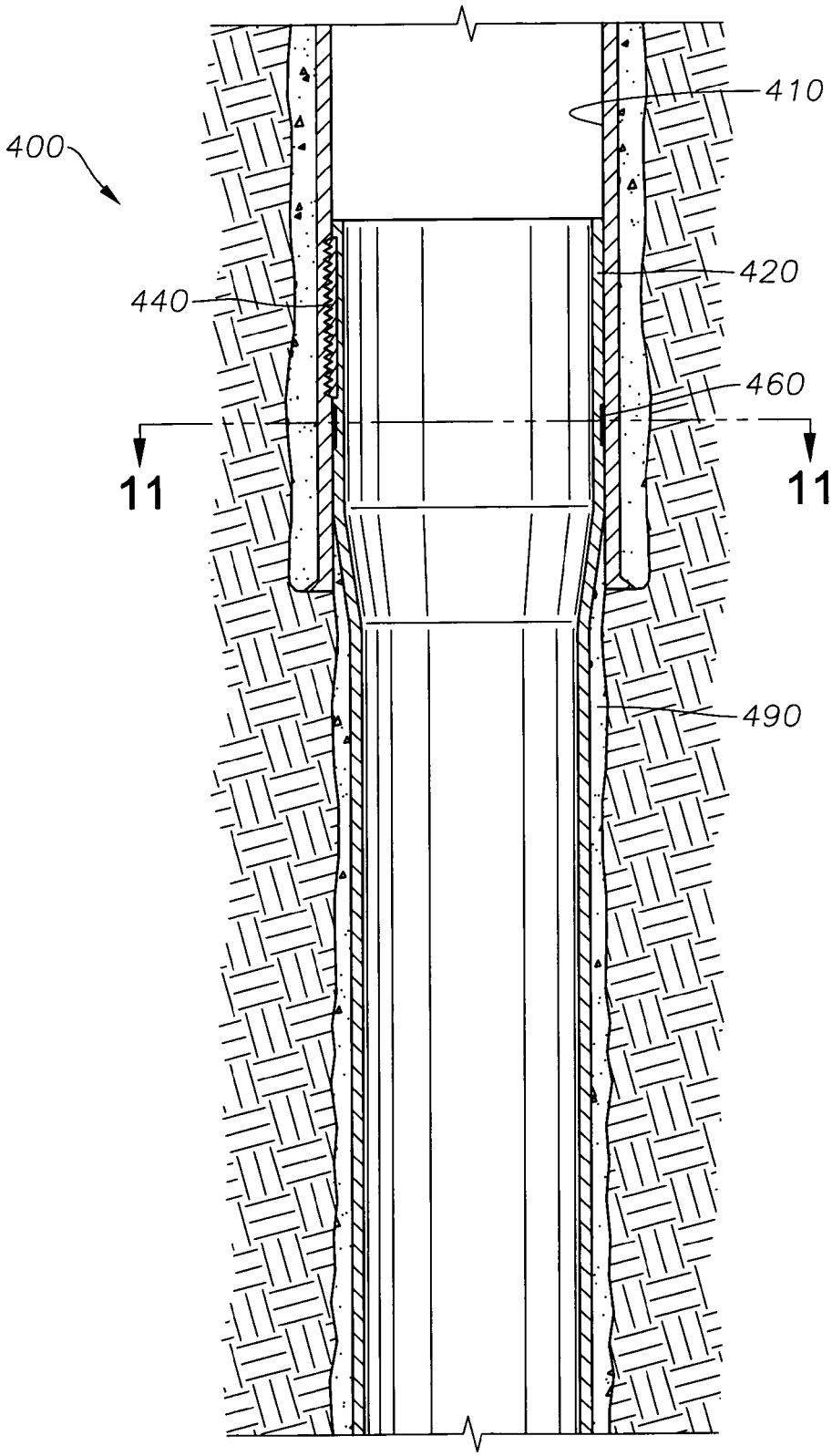
FIG. 10 is a section view of the embodiment shown in FIGS. 3 6, 8 and 9, wherein the liner hanger has been expanded and the run-string and tools removed.
Figure 11:
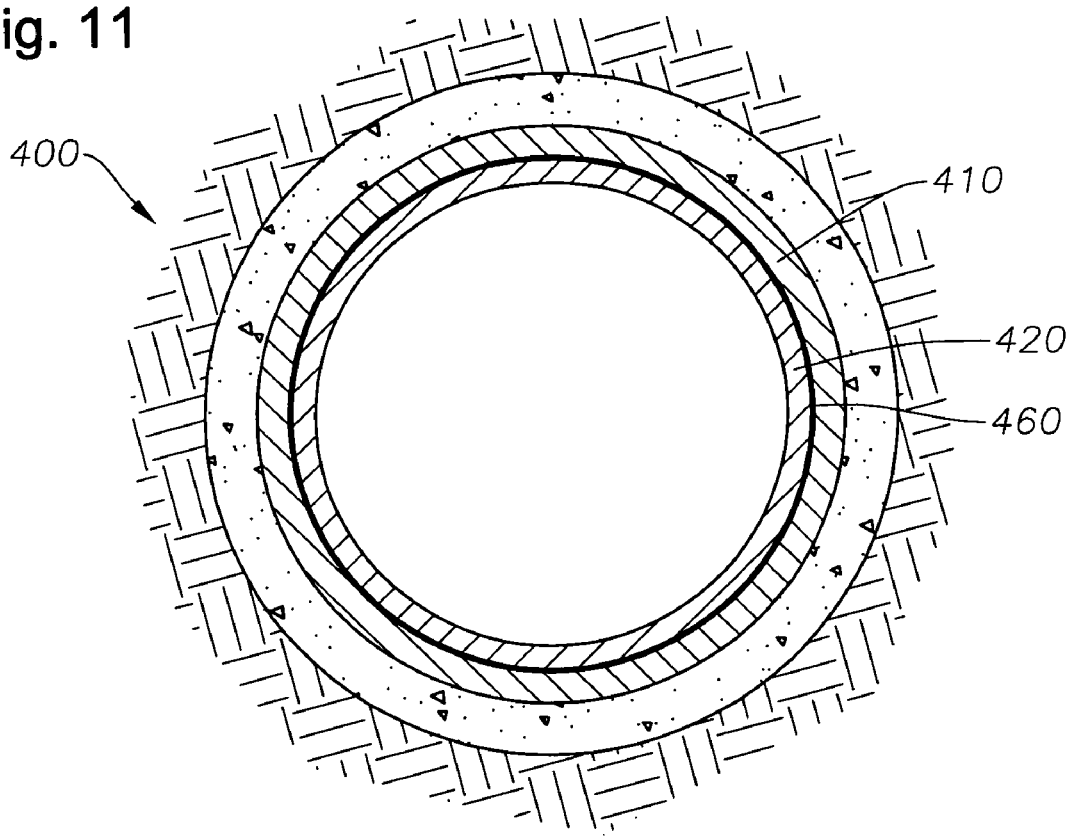
FIG. 11 is a top view of FIG. 10 taken along line 11—11.

FIG. 10 is a section view of the embodiment shown in FIGS. 3, 6, 8 and 9, wherein the liner hanger 420 has been fully expanded into the casing 410 and the run-in string 470 and tools 100, 200 have been removed. As shown in the Figure, the liner is completely set in the wellbore and cemented therein. FIG. 11 is a top view of FIG. 10 taken along line 11—11. The liner hanger 420 and sealing member 460 have been fully expanded into the first tubular 410 to form a liner top seal.

In operation, the assembly described above is run into the wellbore 400 to a desired location. During run-in, the assembly and run-in string 470 may fill with wellbore fluid as there are initially no obstructions in the central bore of the tools 100, 200. When the assembly reaches a location adjacent the casing where the liner will be set, a first ball is deposited in the ball seat 475 of the setting tool 200. Thereafter, pressurized fluid from the run-in string 470 is utilized and actuate the setting members 216 of the tool 200 and cause them to move outwards and into contact with the legs 435 of the liner hanger 420. The pressurized fluid may also cause the rollers 116 of the expansion tool 100 to actuate. However, the actuation has no effect because the expansion tool 100 is located above the liner and the rollers 116 cannot extend to contact the casing 410. As the setting tool 200 exerts forces against the leg 435, the leg 435 is expanded past its elastic limit along at least a portion of its outside diameter where the slip 440 is formed. The slip 440 engages the inner diameter of the casing 410, thereby setting the liner hanger 420 and liner in the casing 410. Alternatively, the expansion tool 100 may be used to set the liner hanger 420.

To ensure that liner hanger 420 is set in the casing 410, the liner hanger 420 may be pulled or pushed down prior to disengaging the carrying dogs 430. Once the liner hanger 420 is set, a pressure above the rated limit of the first ball seat 475 is generated in the run-in string 470 to blow out the first ball and allow fluid, such as cement, to pass through the tool 200 and out the bottom lower end 480 of the run-in sting 470. At this point, the wellbore 400 may be conditioned and/or cemented by any conventional means. Typically, cement is pumped through the run-in string 470 and out the lower end 480 thereof. Return fluid passes on the outside of the liner hanger 420 through the annulus 490 and the bypass 450. The bridge plug 495 prevents return fluid from passing through the inner diameter of the liner hanger 420.

Preferably, when a desired level of cement has been circulated around the liner, the second ball is deposited in the ball seat 485 of the expansion tool 100 to activate the expansion tool 100. Either before or after the ball is deposited in the ball seat, the expansion tool 100 is lowered to a predetermined axial position within the liner hanger 420. With the ball and seat backing the flow of fluid through the tool 100, pressurized fluid is provided through the run-in tubular 470. The fluid urges the rollers 116 outwards to contact the wall of the liner hanger 420 therearound. The expansion tool 100 exerts forces against the wall of the liner hanger 420 while rotating and, optionally, while moving axially within the liner hanger 420. In this manner, the liner hanger 420 is expanded past its elastic limits around its circumference.

Gravity and the weight of the components can move the expansion tool 100 downward in the liner even as the rollers 116 of the expander tool 100 are actuated. Alternatively, the expansion can take place in a "bottom up" fashion by providing an upward force on the run-in tubular string. A tractor (not shown) may be used in a lateral wellbore or in some other circumstance when gravity and the weight of the components are not adequate to cause the actuated expansion tool 100 to move downward along the wellbore 400. Additionally, the tractor may be necessary if the tool 100 is to be used to expand the tubular 420 wherein the tractor provides upward movement of the expansion tool 100 in the wellbore 400. Preferably, the non-compliant rollers 103 at the lower end of the expansion tool 100 contact the inner diameter of the liner hanger 420 as the expansion tool 100 is lowered. This serves to smooth out the legs 435 and reform the liner hanger 420 into a circular shape prior to fully expanding the liner hanger 420 into the first tubular 410. The liner hanger 420 is then expanded into circumferential contact with the casing 410.

To facilitate removal of the run-in string 470, a pressure over and above the operating pressure of the expansion tool 100 is created and the frangible ball seat 485 is caused to fail. The ball falls to a second location within the body of the tool 100 and the flow path through the assembly is again opened. The assembly can then be removed from the wellbore 400 and fluid within the run-in string 470 will drain into the wellbore. While a ball and ball seat are described, it should be understood that any appropriate valve arrangement may be used, such as a sleeve for isolating fluid flow from the run-in string 470 to the setting 200 and expansion 100 tools.

Figure 12:
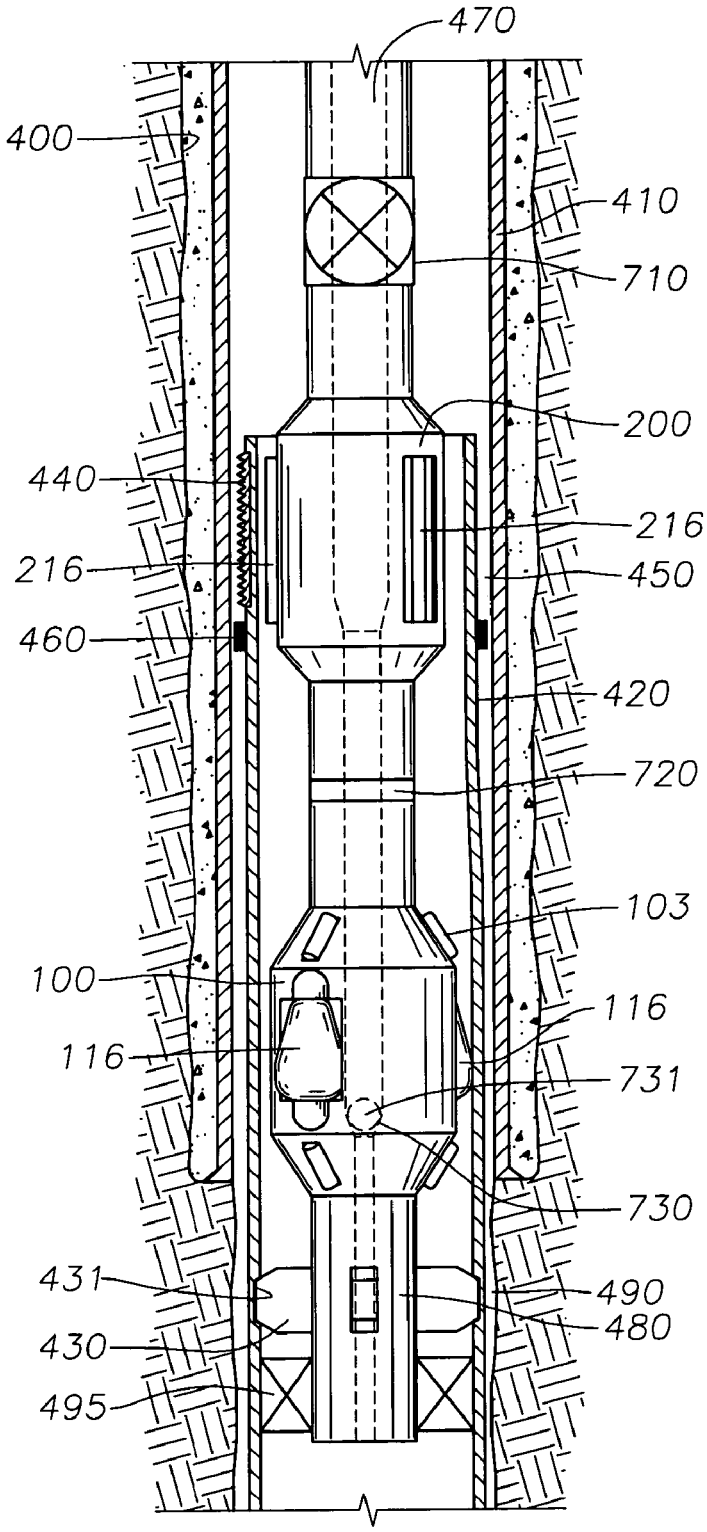
FIG. 12 is a section view of an alternative embodiment.

FIG. 12 is a section view of an alternative embodiment of the invention. An assembly is disposed within a wellbore 400 having casing 410 cemented therein. Temporarily attached to the assembly with carrying dogs 430 is a liner hanger 420. The assembly includes an automatic tubing filler 710 on a run-in string 470 to permit filling of the tubular string during run-in with wellbore fluid; a setting tool 200 to fix the liner within the casing; a frangible disk 720 to temporarily obstruct a flow path through the tubular; and an expansion tool 100 having a frangible ball seat 730 disposed in the lower end thereof. In FIG. 12, a ball 731 is sitting in the ball seat 730. The ball serves to redirect pressurized fluid from the central bore of the tool 100 to the rollers 116.

The liner hanger 420 has one or more slips 440, having grit or teeth, to contact the wall of the casing formed on an outside diameter of an upper end of the tubular 420 at a first location, or leg 435, one or more bypass areas 450 for circulating a fluid at a second location of the upper end, and a sealing member 460 disposed around the outside diameter of the upper end. The leg 435, or protrusion, is formed at the first location between the bypass areas 450. The run-in tubular 470 is used to provide fluid to the setting 200 and expansion 100 tools. The tubular string is open at a lower end 480 thereof. The open end 480 permits fluid, such as cement, to pass downward through the apparatus and to circulate back to the surface of the well through an annulus 490, between the liner and the wellbore 400, and the bypass 450 and the wellbore 400. A bridge plug 495 prevents return fluid from passing through the inner diameter of the liner hanger 420.

In operation, the assembly, including the liner hanger 420, is run into the wellbore 400 to a desired location. The automatic tubing filler 710 allows the run-in string 470 to fill as the assembly is lowered into the wellbore 400. The tubing filler 710 operates by opening when wellbore fluid is at a higher pressure than fluid in the run-in string 470. Similarly, the filler closes when the conditions are opposite, thereby preventing pressurized fluid in the run-in string 470 from escaping through the filler 710. Once the apparatus is located adjacent the casing 410, pressure in the run-in string 470 is increased in order to actuate the setting members 216 causing them to extend outward to contact the inner wall of the liner hanger 420 at the first location, or leg 435. The setting tool 200 exerts radial forces against the leg 435 until the leg 435 expands past its elastic limit along at least a portion of its outside diameter where the slip 440 is disposed. The slip 440 then engages the inner diameter of the casing 410 thereby setting the one or more slips 440 and hanging the weight of the liner hanger 420. Generation of pressure is aided by use of a frangible disk 720 disposed in the run-in string 470 between the setting tool 200 and the expansion tool 100. To ensure that the liner hanger 420 is set, the assembly may be pulled up or pushed down prior to disengaging the carrying dogs 430.

After the liner hanger 420 is set in the casing, pressure above the rated limit of the frangible disk is created to blow out the disk and open a fluid path through the apparatus to allow a fluid, such as cement, to flow through the lower end 480 of the run-in string 470. Typically, cement is pumped through the run-in tubular 470 and out the lower end thereof. Return fluid passes on the outside of the liner hanger 420 and through the annulus 490 and the bypass 450.

When a desired level of cement is achieved, a ball 731 is deposited in ball seat 730 of the expansion tool 100. With the ball in place and the expansion tool 100 located adjacent the liner hanger 420, fluid is diverted from the central bore of the tool 100 to rollers 116 which are urged outwards to contact the wall of the liner hanger 420. Preferably, at an upper end of the expansion tool 100 are a plurality of non-compliant rollers 103 constructed and arranged to initially contact and expand or reform the tubular 420 prior to contact between the tubular 420 and fluid actuated rollers 116. The expansion tool 100 exerts forces against the wall of the tubular 420 therearound while rotating and, optionally, moving axially within the wellbore 400. The liner hanger 420 is then expanded past its elastic limit and into substantial contact with the inner diameter of the wellbore 400. In this aspect, a liner top seal is aided by the sealing member 460. Once the liner hanger 420 has been expanded, a pressure above the rated limit of the frangible ball seat 730 is created allowing the ball to pass to the bottom of the wellbore 400 and fluid to pass through the lower end 480 of the run-in string 470 facilitating removal of fluid in the run-in string 470 during removal from the wellbore 400.

As set forth in the forgoing, the invention provides an effective trip saving apparatus and methods for setting a tubular in a wellbore, circulating fluid, like cement around the tubular, and then sealing the tubular within a wellbore. While means to set and expand the tubular illustrated are fluid powered, it will be understood that any practical means, including mechanical means may be used. While the foregoing is directed to the preferred embodiment of the present invention, other and further embodiments of the invention may be devised without departing from the basic scope thereof, and the scope thereof is determined by the claims that follow.

The invention claimed is:

1. A method of expanding a tubular in a wellbore, comprising:

using a first expander tool to increase a diameter of the tubular in at least one radially discrete direction, thereby leaving at least one radially discrete area unexpanded; and using a second expander tool to increase the diameter of the tubular circumferentially, including the at least one radially discrete direction.

2. The method of claim 1, wherein the first expander tool operates in a rotationally fixed manner and the second expander tool is rotated during expansion of the tubular.

3. The method of claim 1, wherein the expander tools are acuated in a sequential manner and moved axially relative to the tubular.

4. The method of claim 3, wherein the expander tools are operated by fluid pressure from a single run in string of tubulars upon which they are mounted and the fluid pressure is selectively directed to at least one of the expander tools.

5. The method of claim 4, wherein a sealing fluid is circulated between an interior of the run in string of tubulars and an area outside of the tubular between operation of the first and second expander tools.

6. The method of claim 1, wherein using the first expander tool hangs the tubular in the wellbore.

7. A method of expanding a tubular in a wellbore, comprising:

using a first expander tool to increase a diameter of the tubular in at least one radially discrete direction along a first length of the tubular, thereby leaving at least one radially discrete area unexpanded; and using a second expander tool to increase the diameter of the tubular circumferentially along the first length of the tubular and a second length of the tubular different from the first length.

8. The method of claim 7, wherein the first expander tool operates in a rotationally fixed manner and the second expander tool is rotated during expansion of the tubular.

9. The method of claim 7, wherein the expander tools are actuated in a sequential manner and moved axially relative to the tubular.

10. The method of claim 9, wherein the expander tools are operated by fluid pressure from a single run in string of tubulars upon which they are mounted and the fluid pressure is selectively directed to at least one of the expander tools.

11. The method of claim 10, wherein a sealing fluid is circulated between an interior of the run in string of tubulars and an area outside of the tubular between operation of the first and second expander tools.

12. The method of claim 7, wherein using the first expander tool hangs the tubular in the wellbore.

13. An apparatus for expanding a tubular in a wellbore, comprising:

a run in string of tubulars;

a first expander tool disposed on the run in string of tubulars, wherein the first expander tool is configured to increase the diameter of the tubular in at least one radially discrete direction, thereby leaving at least one radially discrete area unexpanded; and a second expander tool disposed on the run in string of tubulars, wherein the second expander tool is constructed to increase the diameter of the tubular circumferentially, including the at least one radially discrete direction.

14. The apparatus of claim 13, wherein the first expander tool is configured to operate in a rotationally fixed manner and the second expander tool is constructed to be rotated during expansion of the tubular.

15. The apparatus of claim 13, wherein the first expander tool has a non-rotational extendable member and the second expander tool has extendable rollers.

16. The apparatus of claim 13, wherein the expander tools are actuatable in a sequential manner and are movable axially relative to the tubular.

17. The apparatus of claim 16, wherein the expander tools are operatable by fluid pressure from the run in string of tubulars and the fluid pressure is selectively directable to at least one of the expander tools.

18. The apparatus of claim 16, wherein a mechanism is capable of selectively directing fluid pressure to at least one of the expander tools.

19. The apparatus of claim 16, wherein a mechanism is capable of selectively directing fluid pressure to activate independently one of the expander tools.

20. The apparatus of claim 13, wherein the at least one radially discrete direction corresponds to a location of a slip on an outside of the tubular.

* * * * *

UNITED STATES PATENT AND TRADEMARK OFFICE

CERTIFICATE OF CORRECTION

PATENT NO. : 7,048,065 B2
APPLICATION NO. : 11/168803
DATED : May 23, 2006
INVENTOR(S) : Robert P. Badrak et al.

It is certified that error appears in the above-identified patent and that said Letters Patent is hereby corrected as shown below:

Title Page

Item (75), Inventors, please delete "McGuire" and insert -- Maguire --.

Signed and Sealed this

Sixth Day of March, 2007

JON W. DUDAS
*Director of the United States Patent and Trademark Office*